US005860352A

United States Patent [19]

Pabsch et al.

[11] Patent Number: 5,860,352

[45] Date of Patent: Jan. 19, 1999

[54] ACTUATOR FOR GENERATING HIGH REGULATING FORCES AND LARGE REGULATING DISTANCES

[75] Inventors: Arno Pabsch; Matthias Piening; Thilo Bein, all of Brunswick, Germany

[73] Assignee: Deutsche Forschungsanstalt, Bonn, Germany

[21] Appl. No.: 816,269

[22] Filed: Mar. 13, 1997

[30] Foreign Application Priority Data

Mar. 13, 1996 [DE] Germany ..... 196 09 733.9

[51] Int. Cl.[6] ..... F01B 19/00

[52] U.S. Cl. ..... 92/90; 92/89

[58] Field of Search ..... 92/48, 89, 90, 92/91, 92, 98 D

[56] References Cited

U.S. PATENT DOCUMENTS

| | | | |
|---|---|---|---|
| 2,947,326 | 8/1960 | Mercier | 92/91 |
| 3,471,668 | 10/1969 | Wilkes | 92/89 |
| 4,090,286 | 5/1978 | Sepso . | |
| 4,296,900 | 10/1981 | Krall . | |
| 4,507,922 | 4/1985 | Kolt . | |
| 4,756,237 | 7/1988 | Shishkin et al. | 92/91 |
| 4,841,843 | 6/1989 | Shishkin et al. | 92/980 |

FOREIGN PATENT DOCUMENTS

| | | | |
|---|---|---|---|
| 28 48 651 | 3/1984 | Germany . | |
| 703680 | 12/1979 | U.S.S.R. | 92/90 |
| 888379 | 1/1962 | United Kingdom | 92/89 |
| 1 405 875 | 9/1975 | United Kingdom . | |
| 2 013 281 | 8/1979 | United Kingdom . | |
| 1 604 686 | 12/1981 | United Kingdom . | |

*Primary Examiner*—Thomas E. Denion
*Attorney, Agent, or Firm*—Salter & Michaelson

[57] ABSTRACT

The invention relates to an actuator (10) for generating high regulating forces and large regulating distances with a web (12) for the transmission of regulating forces, which actuates an internal pressure, which may be purposefully influenced, in an actuator cavity (14), sealed at least in an indirectly pressure-tight manner, wherein a tubular cavity profile (13) forms the active actuator cavity (14), the shell surface of which is heavily indented in linear form in the effective direction (11) of the regulating forces and in the longitudinal direction of the cavity profile (13) to receive and operate the web (12), and the cavity profile (13) is divided into two mirror-symmetric partial cross-sectional faces (15).

11 Claims, 1 Drawing Sheet

ACTUATOR FOR GENERATING HIGH REGULATING FORCES AND LARGE REGULATING DISTANCES

BACKGROUND OF THE INVENTION

The invention relates to an actuator for generating high regulating forces and large regulating distances with a transmission element for the transmission of regulating forces, which actuates an internal pressure, which may be purposefully influenced, in an actuator cavity, sealed at least in an indirectly pressure-tight manner.

The term actuator is generally applied to a component at the output of a control or regulating section, which engages into energy or mass flows. The present invention relates to such an actuator, which additionally complies with the special requirements for installation into supporting structures, e.g. a support wing of a transonic commercial aircraft for carrying the support wing profile in accordance with U.S. Pat. No. 4,296,900. This is not, of course, the only possible application.

DESCRIPTION OF THE PRIOR ART

Electric, hydraulic and pneumatic drives or actuators are mainly used in the prior art to generate large regulating distances with simultaneously high regulating forces by means of an actuator. Which of the known actuators can be used, depends on the existing design possibilities and the physical form of the available power in each case. In the case of electric actuators, a step motor must primarily be mentioned, which represents a more inexpensive solution in comparison to other EC motors. However, the step motor generally exhibits starting problems, falling out of phase in the case of overload and oscillations with sudden changes in state. These characteristics disturb or hinder the necessary adherence to the electric pulse number. Therefore, for a temporally quick and precise positioning, step motors can only be used conditionally, since a reduction in step angle and an increase in step frequency to different torques can incur additional costs and additional losses. Moreover, the dying-out of the motor rotor after the voltage has been switched off increases the positioning time so that additional attenuation is generally mandatory.

Hydraulic drives or actuators known in the prior art have proved more favourable in various respects. With the same power, a hydromotor exhibits substantially better time performance, has a lower weight per unit power and lower installation volume. A particular disadvantage with hydraulics, however, is the compressibility of the oil column and occurring slippage. The high compressibility of the oil is additionally increased by the air dissolved in the oil. Jerky operation, long reversal times and rapid aging results from the presence of air. The slippage is caused by leakages and compressibility. Therefore, in the case of exact positioning, the precision requirement must be met by additional control and/or regulation measures.

An electric, fluid-operated switch is known from U.S. Pat. No. 4,090,286. In this, a fluid flows at corresponding pressure into a membrane construction comprising two small circular discs. The two circular discs abut one another in the central region, while in the peripheral region they form an annular chamber between them. When the fluid flows into this chamber at a specific pressure, the two small discs are pressed apart as a result of this, and thus push a switch operating element against the effective force of a spring. By an extremely complicated mechanism, the operating element is approximately stabilised in its direction; and there is likewise no transmission of a regulating force, instead only a switch-on and switch-off mechanism is provided.

An arrangement for monitoring the temperature of a liquid is known from U.S. Pat. No. 4,507,922. Two metal discs, in particular made of sheet metal, are laid one on top of the other and clamped together on the outside. Between the two discs in the outer region an annular area is formed, in which the liquid is located. The two discs are located one on top of the other in the central region. When the temperature of the liquid is increased, it expands, and with a sufficiently large increase in temperature, it also pushes the central region apart up to a specific maximum. A coupling mechanism arranged on the outer skin can move a transmission element. This transmission element is not stable and can be used virtually exclusively to switch another mechanism on or off. It cannot be considered as a drive or actuator.

Besides the hydromotors, pneumatic drives or actuators are also known, which correspond in principle to the hydraulic units. The difference between hydraulic and pneumatic constructions is essentially based in the properties of the different pressure transfer media. In the case of pneumatic drives use, of the pressurised air transfer medium has various disadvantages which greatly influence the feasibility of the use of such actuators. Hence, as a result of the pressure restriction, such pneumatic actuators have relatively large dimensions.

An actuating drive operated by pressure medium is known from German Patent No. 28 48 651. An approximately cylindrical bellows arrangement is provided here which is equipped with holding members on two opposing longitudinal sides. When the bellows are filled with pressure medium and the inner area is thus circular cylindrical, the two holding members are at a relatively short distance from one another. When the pressure medium is removed from the bellows and the inner sides of the bellows faces come closer to one another, it becomes elongate so that the distance between the holding members increases. In this case, the bellows arrangement itself is made of non-expandable material, e.g. spring metal. This actuating drive has a high space requirement particularly in the direction of the regulating force, and requires intensive additional stabilisation. The direction of the force is non-specific.

In most pneumatic drives or actuators, moreover, the used air must be enriched with oil in order to lubricate the components, and this in turn causes pollution as a result of the oil mist contained in the exhaust air. Further disadvantages which must be mentioned are the pollution through exhaust air noise and the risk of instances of icing. Processing of the used air is also necessary, since the impurities entrained in the air and the condensate must be separated before their use. The power requirement of such a pneumatic actuator is more than ten times greater than that of an electric actuator.

In addition, all the known actuators can be integrated into existing and also supporting structures, e.g. support wings of aircraft, only with great expense, and moreover cannot themselves assume or carry out any supporting stability functions, e.g. bending moments.

A further important disadvantage in all the known actuators is the purely punctiform transmission of force, which requires a special structural design, in particular in the case of flat support wings.

SUMMARY OF THE PRESENT INVENTION

The object of the present invention is to provide an actuator for generating high regulating forces and large regulating distances, which is flat, compact, robust, simple and without internal moving parts, for installation into particularly flat supporting structures, and assures a virtually maintenance-, slippage- and jerk-free operation with short positioning times.

This object is achieved according to the invention by an actuator for generating high regulating forces and large regulating distances with a transmission element for the transmission of regulating forces, which operates an internal pressure which may be purposefully influenced in an actuator cavity, which is sealed at least in an indirectly pressure-tight manner, in which a tubular cavity profile forms the active actuator cavity, the shell surface of which is heavily indented in linear form in the effective direction of the regulating forces and in the longitudinal direction of the cavity profile, and the cavity profile is divided into two mirror-symmetric partial cross-sectional faces, and in which the linear indentation receives a web as transmission element for the regulating forces.

It has been revealed that the actuator of particularly simple construction according to the invention is suitable for generating substantial deformations with moderately large forces, is thereby easily integrated into predetermined structures and can even be a part-structure for assisting in the support of said structures, as a result of which the actuator according to the invention is particularly suitable for influencing the contour of support wings of transonic commercial aircraft, but may also be used wherever large actuator distances are required in association with low structural height, e.g. in motor mountings.

The particularly simple principle according to the invention consists of a cavity profile, which is sealed in axial direction, as always, and also outside an active actuator cavity, or is enclosed, with a symmetrical indentation in the longitudinal direction running in the effective direction of a regulating force, which indentation bends in dependence upon pressure and moves a web disposed therein. The magnitude of the bending and the force to be obtained with it can be directly influenced by the internal pressure in this case. The term cavity profile always refers to the section thereof which is determined by the active actuator cavity, i.e. has an indentation, which can serve to receive a web.

It is preferred if an elastic liner is provided which, in the form of a sealing layer, seals the actuator cavity directly or indirectly. The liner is the element which, amongst other things, assures the pressure-tight closure at the longitudinal ends of the actuator, at which the cavity profile elastically converges or ends in an otherwise non-critical manner. In a way similar to a bicycle inner tube, by analogy, the liner contains the medium changing its internal pressure in a pressure-tight manner. It can sit in the interior of the cavity, as preferred, but can also sit firmly connected to the profile on its outer skin.

A particularly advantageous provision is that the mirror-symmetric partial cross-sectional faces generated by the indentation have an approximately circular or elliptic shape. This not only has the functional advantages outlined further below with respect to the fastening of the web, but also has the advantage that the actuator extending in the longitudinal direction can itself absorb bending forces and thus can simultaneously act as a supporting part of a construction.

The size of the deformation generated in effective direction is determined, besides the internal pressure, by a selected boundary condition on the open ends of the profile pointing to the web. Since no displacement occurs perpendicular to the effective direction and in the longitudinal direction of the actuator because of the symmetry, the open ends of the cavity profile can be disposed moment-free or free from relative rotation. In order to attain large regulating distances, a moment-free arrangement is to be preferred. Besides the approximately circular mirror-symmetric cross-sectional faces, correspondingly elliptic cross-sectional faces may also be formed. They exhibit a virtually identical deformation behaviour with substantially smaller installation heights.

A further advantageous provision is that the indented shell sections of the mirror-symmetric partial sections of the cavity profile respectively have profile ends running into the interior of the cavity profile and in its longitudinal direction, said profile ends holding the web laterally between them. The lateral support of the web also serves, amongst other things, as simple radial centring means thereof in the effective direction of the regulating forces.

An embodiment provides that the cavity profile has the elastic liner on its outer surface, which projects beyond the profile ends on the indented shell sections a long distance into the actuator cavity, and also fully seals this in this region. Here, the elastic liner serves not only to seal the active actuator cavity in the region of the indented shell sections, but also to transfer forces onto the web, the liner enclosing the edge on the cavity side of said web.

An advantageous provision is that the cavity profile is made of composite fibre material and/or super-elastic nickel titanium and/or a suitable elastic metal. Although the composite fibre materials may be advantageously used because of their weight, it may be necessary to also use metal materials in some applications.

It is further provided in an embodiment that the web projects between the profile ends of the indented shell sections and through into the actuator cavity, and there has a thickened portion, which may be inserted from the outside into a strap of the liner, for example. As already stated, the liner can project a long distance into the interior of the actuator cavity in this region. As a result, it can receive the thickened portion of the web in a strap running in the longitudinal direction of the cavity profile, likewise to form a seal, and at the same time seal off this region, in which case the web is prevented from slipping out of the cavity profile because of the thickened portion. The thickened portion can also taper downwards in a point and be broader at the top to further improve the locking arrangement, and be constructed in the shape of a hook.

According to a further arrangement of the invention it is provided that the indentation projects so far into the centre of the cavity profile that a pneumatic or hydraulic internal pressure moves the profile ends of the indented shell sections towards one another, clamping the web, and at the same time presses this with its thickened portion against the inner regions of the profile ends, and thus effects a radial movement of the web out of the centre when the cavity profile section located opposite the web is supported.

Irrespective of the generation of internal pressure in the cavity profile, e.g. by pneumatic or hydraulic means, this assures in the simplest manner that the web is guided exactly radially to the centre of the cavity profile cross-section in accordance with the desired effective direction, and has a secure fastening, namely through compressing the web and the thickened portion between or on the profile ends. With a corresponding supporting arrangement of the cavity profile, namely in point form in the effective direction relative to the indented shell section or linearly in the longitudinal direction of the cavity profile, a defined radial movement of the web out of the centre of the cavity profile cross-section is possible in a simple manner.

A further advantageous provision is that the web is constructed as a rectangular plate, and extends with its longest edges over the full length of the cavity profile in its indentation. This allows the regulating forces to be transferred not only in point form but linearly in the simplest manner. Despite being basically rectangular in construction, the linear web connecting to the structure and transferring the forces can, moreover, be adapted to the structure and thus simplify the construction of the structure considerably.

A further provision according to the invention is that the cavity profile is closed in longitudinal direction to form a circle or torus, and the web forms a cylindrical ring, which is movable in the axial direction of the main axis of the torus. A plurality of possible further advantageous arrangements and uses result from this. Only the secure support resulting from the circle, which also permits obliquely acting regulating forces to a certain extent, shall be mentioned here.

The cavity profile of the actuator is advantageously composed of interconnected inner and outer shells and has shell sections interlocking the profile ends. This dual-shell arrangement of the toroidal actuator according to the invention enables the finishing process to be simplified. In comparison to the elongated cylindrical structure, with which a regulating force can be made available along a line, a ring-shaped regulating force and/or punctiform regulating force can be made available with the toroidal actuator. In addition, the toroidal actuator is robust with respect to forces acting obliquely.

Therefore, it can be established overall that the actuator according to the invention has a plurality of advantages over known electric, hydraulic and pneumatic actuators. Besides the important possibility of integration into the structure already mentioned, the actuator according to the invention is distinguished by a low structural height and a compact construction.

Since it has no moving parts, such as pistons, gears or belts etc., it is extremely low in maintenance with a power requirement determined solely by the generation of the necessary internal pressure. Hence, serious disadvantages with hydraulic or pneumatic constructions are avoided with the actuator according to the invention. For example, no expensive seals are necessary because of the low internal pressure necessary for the hydraulic system and the internal moving parts otherwise unnecessary. The risk of air inclusion and slippage, jerky operation and long reversal times are also reliably prevented as a result of this. In addition, no leakages occur, nor the pressure losses associated with them.

Moreover, with a pneumatically generated internal pressure, an oil enrichment of the air may be dispensed with. Similarly, impurities in the air do not detrimentally affect the operation of the actuator, and therefore filters can be dispensed with completely and only the risk of icing and the nuisance resulting from exhaust air noise remain. However, since icing can be prevented by charging with dried air from a reservoir, an actuator that is also robust in this regard is provided. As already mentioned, the actuator can be a component assisting in the support of the structure and thus does not impair its function in the case of breakdown.

DESCRIPTION OF THE DRAWINGS

Embodiments of the present invention are explained in more detail below with reference to the accompanying drawings, in which.

DESCRIPTION OF THE PREFERRED EMBODIMENT

Figure 1:
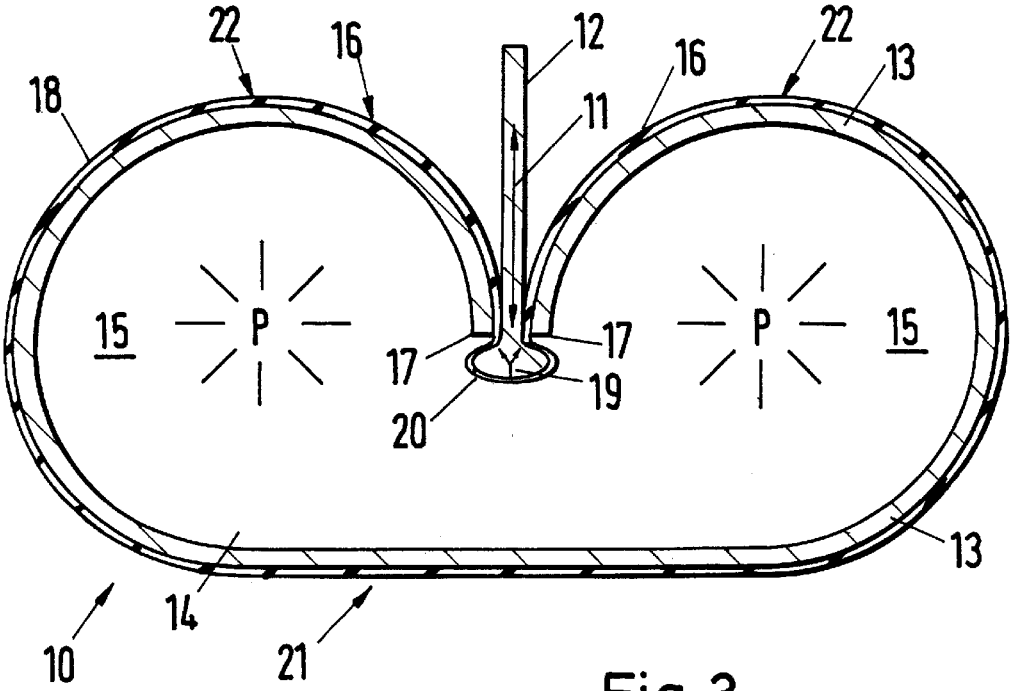
FIG. 1 shows a cross-section through an actuator according to the invention.

FIG. 1 shows a cross-section through an actuator 10 according to the invention, which has a web 12 movable in the effective direction in accordance with arrow 11 for the transfer of the high regulating forces generated. The web 12 covers a regulating distance in the direction of arrow 11, upwards in FIG. 1. The web 12 engages into a cavity profile 13, from which an actuator cavity 14 is formed, in which an internal pressure P that may be purposefully influenced is built up, ultimately moving the web 12 in the desired manner. The section of the cavity profile 13, which may have a web 12, defines the actuator cavity 14, which is active and always meant thereby. This means that the cavity profile can lead on to both sides of the actuator 10 in the case of a cylindrical actuator 10.

It is provided according to the invention that the cavity profile 13 is constructed in a tubular shape and, in the effective direction according to arrow 11 and also in the longitudinal direction of the cavity profile 13, its shell face is heavily indented in a linear shape to receive and operate the web 12, and the cavity profile 13 is thus divided into two mirror-symmetric partial cross-sectional faces 15. The mirror-symmetric partial cross-sectional faces 15 generated by the indentation can have an approximately circular shape. Besides the circular shape shown in FIG. 1, elliptic shapes are also possible. These exhibit approximately the same deformation behaviour with substantially lower installation heights.

The indented shell sections 16 of the mirror-symmetric partial sections of the cavity profile 13 respectively have profile ends 17, which extend into the interior of the cavity profile 13 and in the longitudinal direction thereof and hold the web 12 laterally between them.

On its outer surface and also over and beyond its longitudinal ends not shown in FIG. 1, the cavity profile 13 is fully sealed in the region of the actuator cavity 14 with an elastic liner 18, whereby the liner 18 projects a long distance into the actuator cavity 14 beyond the profile ends 17 on the indented shell sections 16 and completely closes off this section. This makes it possible in a simple manner for the web 12 to project between the profile ends 17 of the indented metal sections 16 and through into the actuator cavity 14, and have an elliptic or circular thickened portion 19 there, shown in FIG. 1, which may be inserted from the outside into a strap 20 of the liner 18. The cavity profile 13 is advantageously made of composite fibre material, but may also be made of super-elastic nickel titanium or from conventional elastic metals.

The indentation or the profile ends 17 project so far into the centre of the cavity profile 13 that a pneumatic or hydraulic internal pressure P moves the profile ends 17 of the indented shell sections 16 against one another, thus clamping the web 12 in position. The thickened portion 19 of the web 12 is also pressed by the internal pressure P against the inner regions of the profile ends 17, shown pointing downwards in FIG. 1, so that in the case of a structural support of the cavity section 21 opposite the web 12, a radial movement of the web 12 is purposefully effected out of the centre in the effective direction in accordance with arrow 11. This means that the web 12 is initially moved outwards by the internal pressure P until its thickened portion 19 strikes against the profile ends 17, and only permits further movement in conjunction with this, while at the same time the web 12 is directed through the constantly higher contact pressure of the profile ends 17 to the side and exactly in radial direction 11. Moreover, a complete seal is assured because the liner 18 is compressed into these contact regions.

Figure 2:
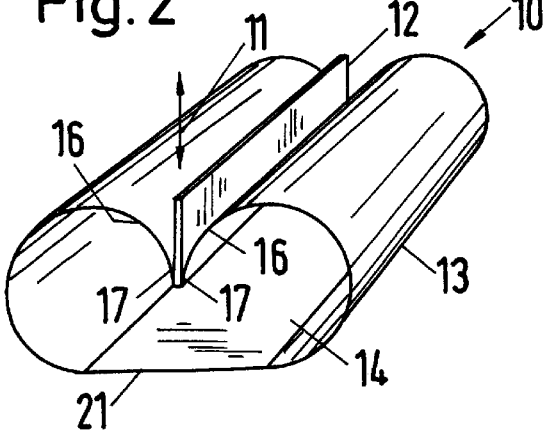
FIG. 2 shows a perspective view of a cylindrical actuator according to the invention.

FIG. 2 shows a perspective view of a cylindrical actuator 10 according to the invention. It may be clearly seen, that the web 12 is arranged between the indented shell sections 16 and the profile ends 17, and extends along the cylindrical actuator 10, i.e. its active actuator cavity 14. Also visible is the cavity profile section 21 supported against a substrate. Since the purpose of this FIG. 2 is only to illustrate the cylindrical shape of the actuator 10 according to the invention, any further details have been omitted from the drawing in FIG. 2. These may be seen in FIG. 1. However, FIG. 2 clearly shows that the actuator 10 according to the invention is formed substantially from a cylindrical cavity profile 13, the end faces of which are substantially open, however, because of the liner 18, not shown here, this nevertheless provides the required internal pressure. Since because of the symmetry no displacement occurs perpendicular to the effective direction in accordance with arrow 11 and in the longitudinal direction of the actuator 10, the open ends 17 of the hollow profile 13 may be disposed both moment-free and free from relative rotation. A moment-free arrangement is preferable to attain substantial deformations. The connection to the structure, e.g. to a support wing of an aircraft, is achieved by means of the plate-shaped web 12 engaging into the profile ends 17.

The actuators must be presented with fully relevant lengths in relation to the cross-sectional dimensions of the cavity, e.g. lengths in the region of about 30 m with diameters in the centimeter range. The defined construction of the longitudinal ends is consequently non-critical and can be achieved in dependence on the surrounding requirements.

Figure 3:
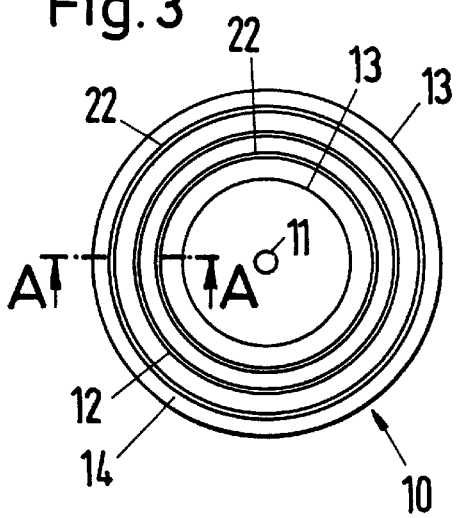
FIG. 3 shows a plan view onto an actuator constructed in the shape of a torus.

FIG. 3 shows a plan view onto an alternative actuator 10 according to the invention constructed in the shape of a torus. As stated in conjunction with FIG. 2, the cylindrical actuator 10 can be circular and be enclosed, and thus form the toroidal actuator 10 shown in FIG. 3. The drawing clearly shows the cavity profile 13 with the highest profile sections 22 pointing to the observer, and the indented shell sections 16 running between these, between which the now circular and cylindrical web 12 extends. Upon the application of pressure, the web 12 can be shifted in the direction of arrow 11 towards the observer. As a result of this, a force along a ring-shaped line can be generated in contrast to the cylindrical actuator 10, with which a force is possible along a line. This has the advantage, amongst other factors, that lateral forces can also act on the cylindrical web 12 without having a negative influence on the function of the actuator, which is substantially prevented in a cylindrical actuator according to FIG. 2 solely as a result of the pressing action of the profile ends 17 on the web. For the sake of simplicity, the manner of pressure application has been omitted from the drawing in FIG. 3, as in all the other figures. Reference is made to the description of FIG. 1 for other details.

Figure 4:
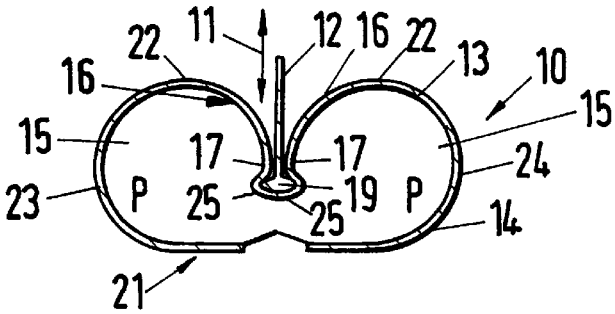
FIG. 4 shows a cross-section taken along line A—A of the toroidal actuator according to FIG. 3.

FIG. 4 shows a section taken along line A—A of the toroidal actuator 10 according to FIG. 3. However, exactly the same section would also be possible in a non-toroidal actuator. Although most of the details have also been omitted in this FIG. 4, and reference is made to FIG. 1 in this regard, the web 12 and its thickened portion 19 are clearly visible. The latter is separated into two shells. This means that there is an outer shell 23 and an inner shell 24, which are directly connected in the region of the support section 21, and their profile ends 17 have further interlocking shell sections 25, which ensure that the dual-shell, toroidal actuator 10 according to the invention is securely held together without influencing the mobility of this section. Reference is made to FIG. 1 and its description for other details.

It is to be understood that the above description is made for illustrative purposes only and that various modifications and alterations will be apparent to the skilled person and which are intended to be incorporated in the scope of the present invention. The present invention is therefore only to be defined by the claims.

What is claimed is:

1. An actuator for generating high regulating forces and large regulating distances, the actuator comprising:

a transmission element for transmitting regulating forces; and a tubular cavity profile arranged and constructed to form an actuator cavity, said tubular cavity profile including a shell surface having an indentation along a longitudinal axis thereof at a midpoint of said tubular cavity profile, said tubular cavity profile thereby being dividing into two sections which are symmetrical about said midpoint of said tubular cavity profile;

said actuator cavity being sealed in a pressure-tight manner and being coupled to said transmission element such that the transmission element is capable of actuating an internal pressure within said actuator cavity;

wherein said transmission element comprises a web which is received within said indentation of said tubular cavity profile.

2. The actuator of claim 1, wherein each of said sections are substantially circular in shape.

3. The actuator of claim 2, wherein each of said sections of said tubular cavity profile comprise profile ends extending along said longitudinal axis proximal said indentation, said profile ends securing said web within said indentation.

4. The actuator of claim 1, further comprising a liner disposed about a periphery of said tubular cavity profile for sealing said actuator cavity.

5. The actuator of claim 4, wherein said liner projects beyond said profile ends into said actuator cavity.

6. The actuator of claim 1, further comprising a liner disposed about an interior of said actuator cavity for sealing said actuator cavity.

7. The actuator of claim 1, wherein said tubular cavity profile is formed from a composite fiber material.

8. The actuator of claim 1, wherein said tubular cavity profile is formed form nickel titanium.

9. The actuator of claim 3, wherein said web comprises a thickened end portion, said web extending between said profile ends into said actuator cavity such that said thickened end portion is disposed within said actuator cavity, beyond said profile ends.

10. The actuator of claim 9, wherein an pneumatic or hydraulic pressure within said actuator cavity urges said profile ends toward each other, clamping said web therebetween, while causing said thickened end portion of said web to push said profile ends radially away from a center of said actuator cavity.

11. The actuator of claim 1, wherein said tubular cavity profile is in the form of a torus.

* * * * *